United States Patent [19]

Utt

[11] 4,078,995

[45] Mar. 14, 1978

[54] EARTHWORM HARVESTING APPARATUS

[76] Inventor: Daniel W. Utt, 15825 Saticoy St., Van Nuys, Calif. 91406

[21] Appl. No.: 691,426

[22] Filed: Jun. 1, 1976

[51] Int. Cl.[2] ..... B07B 1/22

[52] U.S. Cl. ..... 209/235; 209/284; 209/288

[58] Field of Search ..... 209/235, 240, 284, 288, 209/2; 119/155

[56] References Cited

U.S. PATENT DOCUMENTS

| | | | |
|---|---|---|---|
| 927,051 | 7/1909 | Jensen | 209/284 |
| 1,677,862 | 7/1928 | Herrold | 209/288 |
| 2,303,222 | 11/1942 | Murray | 209/288 |
| 3,036,710 | 5/1962 | Axsom | 209/235 |

*Primary Examiner*—Hiram H. Bernstein

*Attorney, Agent, or Firm*—Robert E. Geauque

[57] ABSTRACT

An apparatus and method for harvesting earthworms from a bedding comprising a drum rotatably mounted upon a housing, the housing including a base which is adapted to be placed upon a planar supporting surface, the drum being formed of a plurality of parallel elongated rods arranged in a circular manner with spaces between the rods, the longitudinal center axis of the drum being located in an inclined manner with respect to the base of the housing, and material inlet means connected to the housing to supply material to the interior of the drum, outlet means connected to the housing located adjacent the other end of the drum for discharging material from the interior chamber of the drum, and means for effecting rotation of the drum with respect to the housing.

3 Claims, 4 Drawing Figures

EARTHWORM HARVESTING APPARATUS

BACKGROUND OF THE INVENTION

The field of this invention relates to agriculture and more particularly to an apparatus for the separating of earthworms from their bedding.

Earthworm farms are, at the present time, quite common. Such a farm usually takes the form of longitudinal rows of piles of manure and a quantity of earthworms are placed within the pile of manure. The manure is watered frequently and the earthworms proceed to feed on the manure and produce castings (excrement of the earthworm). The earthworm will begin feed at the bottom of the pile and then, after a period of time, will move to the top area of the manure pile.

When the earthworms are in the top area of the manure pile, the top layer of material is removed and the earthworms which have multiplied tremendously in number and have grown to a large size are to be removed from the material of this portion of the pile. At the present time, the normal method for removing the earthworms from the material comprises placing the material in a lighted environment. The worms have a tendency to move away from the light and therefore further down the material so after a period of time the top layer of material is removed which should contain little or no worms and the procedure repeated until there is principally nothing but worms.

This procedure has proved to be undesirable because at this time it is required to separate the larger worms from the smaller worms, the smaller worms to be replaced back into the manure pile to repeat the breeding procedure. The larger worms would then be sold. Commercially to be used for fish bait or other uses.

However, the light affects the skin of the worms and many of the smaller worms will actually be killed. Also, the procedure for extracting the worms is definitely time consuming as it depends upon the movement of the worms themselves.

There is a definite need for the designing of a physical means to separate worms from the castings with only large worms being removed and the smaller worms remaining within the sifted castings which can then be resupplied to a source of food.

SUMMARY OF THE INVENTION

The structure and method of this invention relates to a base which is formed as a part of a housing. The housing has rotatably supported there upon a drum. The drum is formed of a plurality of parallel elongated members arranged adjacent one another but with spaces therebetween. There is an inlet provided to the interior of the drum and there is also an outlet from the interior of the drum at the opposite end of the housing. The drum is slightly inclined in a downward direction from the inlet to the outlet. Beddings, which has included therein a quantity of earthworms, are supplied to the interior of the drum through the inlet. The drum is rotated at a constant velocity and the bedding containing the small worms are permitted to fall through the spaces of the parallel elongated members to a collecting area. The larger sized earthworms are moved within the interior chamber of the drum and longitudinally there along to the outlet and then are discharged through the outlet. The collected earthworms are to be placed within their appropriate containers and disposed of commercially. The bedding and small earthworms which have collected on the collecting area are placed within breeding material and the breeding procedure repeated.

The primary objective of this invention is to employ a physical means for separating earthworms from their bedding which does not require the use of any type of light or any other type of means which could prove damaging to the earthworms.

BRIEF DESCRIPTION OF THE SHOWN EMBODIMENT

Figure 1:
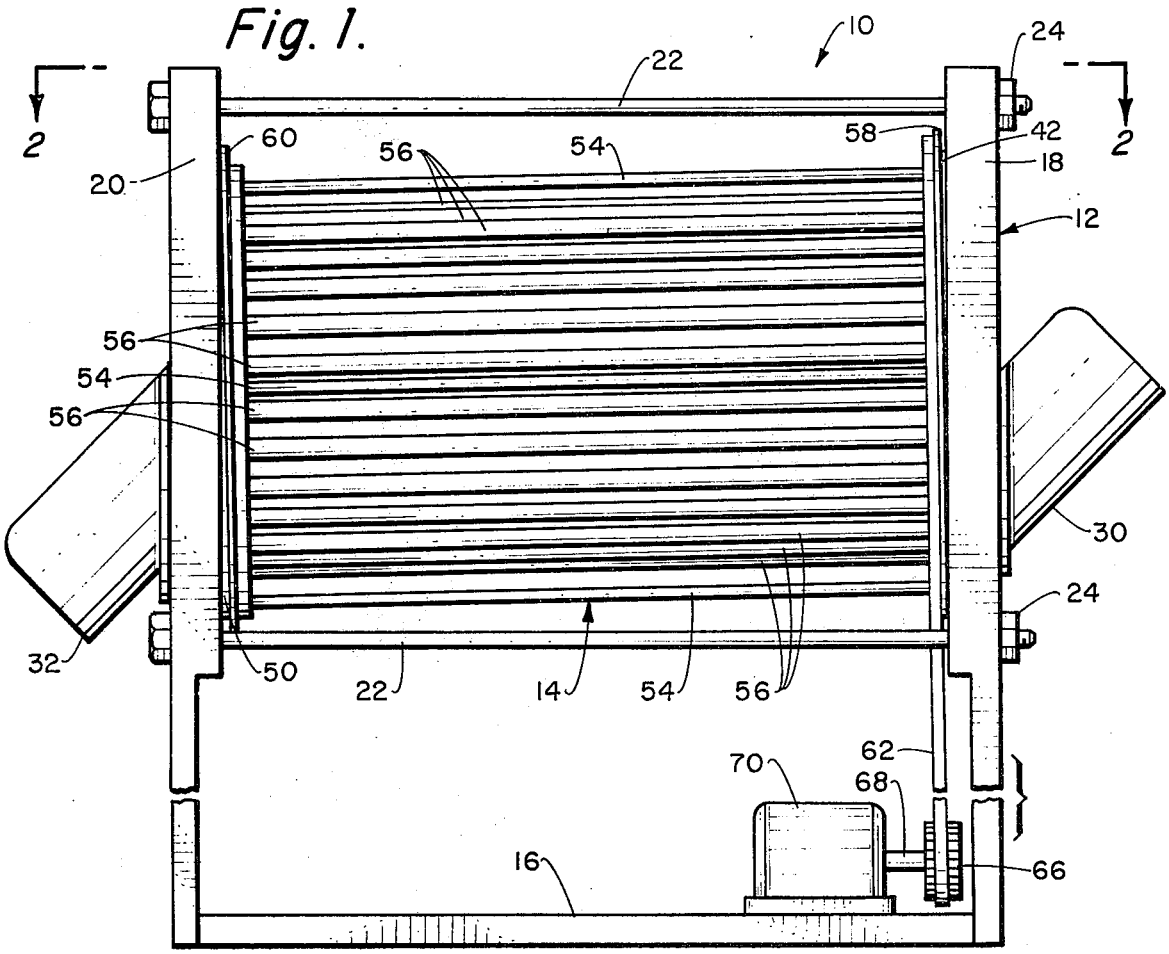
FIG. 1 is a side elevational view of the earthworm harvesting apparatus of this invention.
Figure 2:
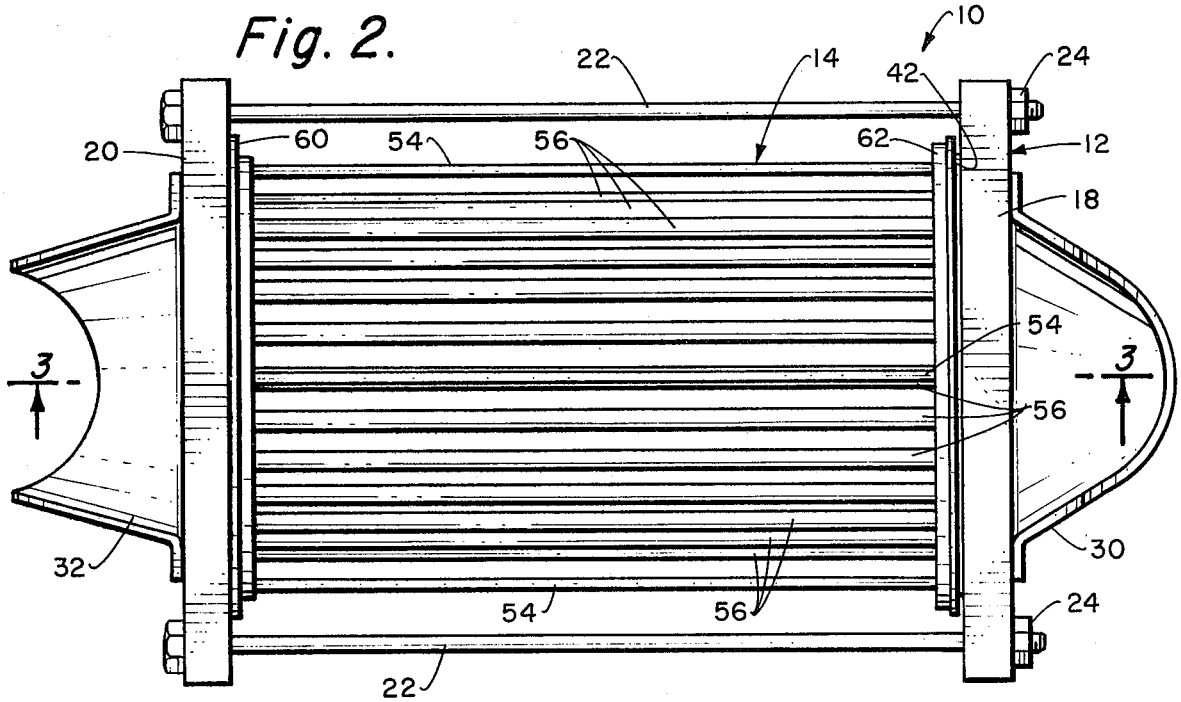
FIG. 2 is a plan view of the apparatus of this invention taken along line 2—2 of FIG. 1.

Referring particularly to the drawings there is shown the apparatus 10 of this invention which is composed generally of a housing 12 and a drum 14. The housing 12 takes the form of a flat base 16 to which are secured to each longitudinal end thereof upstanding side plates 18 and 20. The side plates 18 and 20 are interconnected through connecting rods 22 which merely comprise longitudinal conventionally threaded members which are passed through appropriate aligned opening means formed within the side plates 18 and 20 and are secured by connecting nuts 24. There are four in number of the members 22 employed with these members being spaced equidistantly around the drum 14.

Formed within the side plate 18 is an interior opening 26. Formed within the side plate 20 is an enlarged opening 28. Attached to the side plate 18 on the exterior surface thereof adjacent the opening 26 is an inlet frontal member 30. Attached to the side plate 20 adjacent the opening 28 is a discharge chute 32.

Formed within the interior side of the side plate 18 is an annular recess 34 located concentrically about the opening 26. In a similar manner, an annular recess 36 is formed within the interior side of the side plate 20 and concentrically disposed about the opening 28. The recesses 34 and 36 are to form tracks for rollers 38 and 40, respectively.

The rollers 38 are low frictionally rotationally supported by bearing assemblies 44 within an end plate 42. There are four in number of the rollers 38 being equidistantly spaced about around an enlarged opening 46 formed within the end plate 42. The opening 46 is approximately the same size as the opening 26 and is located directly adjacent thereto.

In a similar manner, the rollers 40 are low frictionally supported by bearing assemblies 48 within an end plate 50. The end plate 50 includes an enlarged opening 52 which is the same size and located directly adjacent the opening 28. A supporting rod 54 interconnects each pair of aligned openings for the aligned pair of roller assemblies 38 and 40. This means that there will be four in number of the rods 54 since there are four in number of the rollers located at each end of the drum 14.

Secured to the end plate 42 about the opening 46 and arranged in a circular manner are a plurality of cylindrical shaped rods 56. It is to be noted that there is twenty-six in number of the rods 56, but it is considered to be within the scope of this invention that any selected number of rods 56 could be employed. The determining criteria for the rods 56 is that for the large earthworm a spacing of about one-half inch between the rods is preferable. The diameter of each of the rods 56 is also about one-half inch. If the drum was being used to separate the smaller red worm, the spacing between adjacent rods 56 would preferably be about one-fourth of an inch. The free end of the rods 56 is secured to the end plate 50 about the opening 52.

The type of material of construction of the rods 56 can be any rigid material, but preferably would be wood, metal, or plastic.

Figure 3:
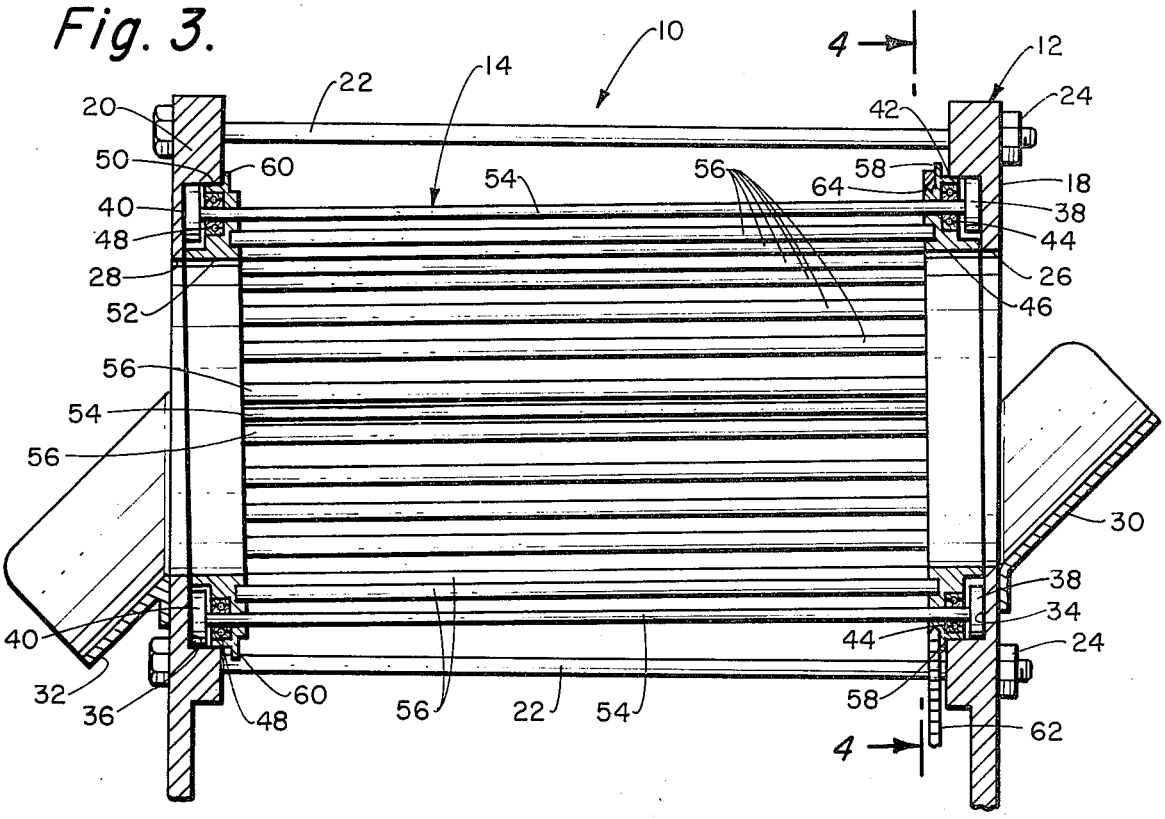
FIG. 3 is a cross-sectional view of the apparatus of this invention taken along line 3—3 of FIG. 2.
Figure 4:
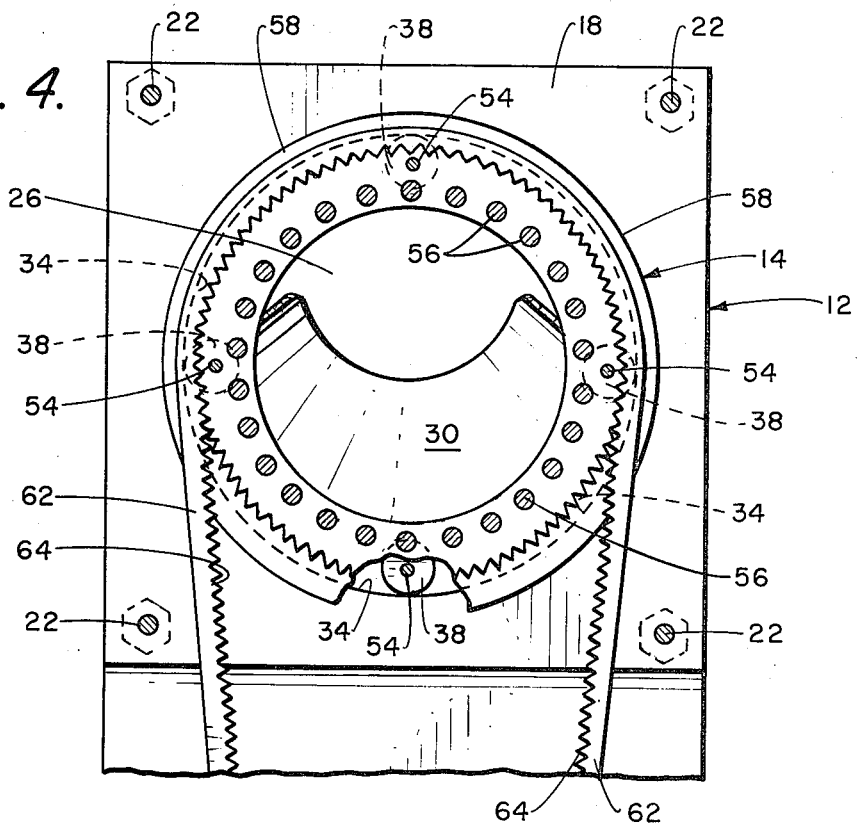
FIG. 4 is a cross-sectional view showing one end of the drum incorporated within the apparatus of this invention taken along line 4—4 of FIG. 3.

Referring in particularly to FIGS. 1 and 3 of the drawings, it is shown that the drum 14 is canted or inclined with respect to the base 16. This inclination is such that the end of the drum 14 adjacent the opening 26 is higher (or located farther from the base 16) than the portion of the drum 14 located adjacent the opening 28. The preferable amount of inclination is approximately one-half inch per foot of length of the drum 14.

Formed on the exterior surface of the end cap 42 is an annular flange 58. A similar such flange 60 is formed on the exterior surface of the end cap 50. The flange 58 is to prevent debris from falling into contact with the track 34. The flange 60 is to similarly prevent debris from entering the track 36.

The drum 14 is rotatably driven by a drive belt 62 which rides within a drive belt groove 64 formed upon the exterior surface of the end cap 42. The belt 62 is mounted upon a pulley 66. The pulley 66 is attached to a drive shaft 68 of a motor 70. The motor 70 is mounted in any convenient location, such as adjacent to or on the base 16. The motor 70 is selected so as to drive the drum 14 at approximately thirty revolutions per minute.

The operation of the device 10 of this invention is as follows: Bedding which include earthworms are fed into the inlet shoot 30 and into the interior of the drum 14. The drum 14 is being rotated by motor 70. The bedding and the contained earthworms are moved about upon the rods 56 with the result that the bedding tends to fall through the spaces located between the rods 56 and the large sized earthworms tend to remain within the interior chamber of the drum 14. Because of the inclination of the drum, the earthworms are moved along the interior surface of the drum 14 and are finally discharged through shoot 32. By this time practically all of the bedding has been completely removed and is passed through the spaces between rods 56 and have fallen into the collecting area located on the base 16. The earthworms which have been passed through the chute 32 are collected and then are disposed of commercially. The bedding and small sized earthworms which are collected on the base 16 are redeposited upon a pile of new bedding upon which the earthworms are permitted to breed and grow.

What is claimed is:

1. An earthworm harvesting apparatus comprising:

a housing, said housing having a base adapted to rest upon a planar supporting surface;

a drum rotatably mounted by rotation supporting means on said housing, said drum being constructed of a plurality of parallel, evenly spaced elongated, cylindrical members arranged adjacent one another with spaces therebetween, said elongated member defining an interior chamber, each said elongated member having a longitudinal center axis, said drum having a longitudinal center axis which is parallel to the longitudinal center axis of said elongated members, said longitudinal center axis of said drum being inclined in respect to said base;

inlet means connected to said housing adjacent one end of said drum, said inlet means supplying a quantity of material into said interior chamber;

outlet means connected to said housing adjacent the other end of said drum, said outlet means for discharging material from said interior chamber, said inclination of said housing being such that the portion of said drum at said outlet means is nearer said base than the portion of said drum at said inlet means; and said rotation supporting means comprises a roller assembly connected to each end of said drum, said roller assembly cooperating with track means formed within said housing, thereby rotatably supporting said drum without there being any structure located within said interior chamber to interfere with movement of material in said interior chamber wherein debris deflection means located adjacent each roller assembly, said debris deflection means attached to said drum, said debris deflection means to prevent debris from coming into contact with said track and hinder the rotational movement of each said roller assembly.

2. The apparatus as defined in claim 1 wherein:

the spacing between the elongated members is within the range of one-quarter inch to one-half inch.

3. The apparatus as defined in claim 2 wherein:

the inclination of the drum is approximately one-half inch per foot of the length of the drum.

* * * * *